United States Patent [19]

Cowhey

[11] Patent Number: 4,751,749

[45] Date of Patent: Jun. 21, 1988

[54] ATHLETIC TRAINING GLOVES

[76] Inventor: James R. Cowhey, Box 7, Chappaqua, N.Y. 10514

[21] Appl. No.: 741,373

[22] Filed: Jun. 5, 1985

[51] Int. Cl.[4] ..... A41D 13/10

[52] U.S. Cl. ..... 2/161 A; 2/163; 2/164; 2/167

[58] Field of Search ..... 2/159, 161 R, 161 A, 2/162, 163, 164, 167, 168

[56] References Cited

U.S. PATENT DOCUMENTS

| | | | |
|---|---|---|---|
| 2,231,204 | 2/1941 | Turner | 2/163 X |
| 2,736,034 | 2/1956 | Fredenhagen et al. . | |
| 2,907,046 | 10/1959 | Scherr | 2/159 |
| 2,913,729 | 11/1959 | Wisenburg | 2/167 |
| 3,597,765 | 8/1971 | Stanton | 2/161 A X |
| 3,707,730 | 1/1973 | Slider . | |
| 3,944,220 | 3/1976 | Fasano . | |
| 4,047,251 | 9/1988 | Stockum | 2/163 X |
| 4,183,100 | 1/1980 | De Marco . | |
| 4,186,445 | 2/1980 | Stager | 2/164 |
| 4,197,592 | 4/1980 | Klein . | |
| 4,228,548 | 10/1980 | Cohen . | |
| 4,290,147 | 9/1981 | Bruckner et al. . | |
| 4,374,439 | 2/1983 | Norman | 2/161 A |
| 4,411,024 | 10/1983 | Hayes | 2/161 A X |
| 4,417,359 | 11/1983 | Johnson | 2/161 A |
| 4,445,232 | 5/1984 | Nelson | 2/164 X |
| 4,514,460 | 4/1985 | Johnson | 2/168 X |

FOREIGN PATENT DOCUMENTS

| | | | |
|---|---|---|---|
| 1128701 | 3/1982 | Canada | 2/161 A |
| 2721410 | 11/1978 | Fed. Rep. of Germany | 2/161 A |
| 2807658 | 9/1979 | Fed. Rep. of Germany | 2/161 A |
| 3135756 | 4/1983 | Fed. Rep. of Germany | 2/161 A |
| 1514101 | 9/1968 | France | 2/159 |
| 2498935 | 8/1982 | France | 2/161 A |

*Primary Examiner*—Andrew M. Falik

*Attorney, Agent, or Firm*—Pennie & Edmonds

[57] ABSTRACT

An athletic training glove having a plurality of layers which includes a hand defining pocket, an outer backing layer and a resilient foam layer disposed between the pocket and the backing layer. Perforations may be provided for ventilation. The glove may be provided with a protective layer on the palm to accommodate wear during normal use. The sides of the finger portions extend beyond the lateral edges of the fingers to assist in exercising the hand.

12 Claims, 3 Drawing Sheets

ATHLETIC TRAINING GLOVES

BACKGROUND OF THE INVENTION

This invention relates to the field of athletics and exercise training. The invention enables the individual to train for a sport, exercise or engage in activity while simultaneously wearing the Athletic Training Gloves. While training in any sport, exercising or engaging in activity, the athletic training gloves increase and develop muscular strength in the fingers, wrists, forearms and upper arms.

In many types of sports, part of the Athletic Training program usually requires physical conditioning. This physical conditioning often includes a weight training program. The weight training program is performed on one or a combination of weight training facilities, such as free weights for free body movements or weight machines which concentrate on specific muscle areas. Each of these weight training styles as well as most of the other exercise equipment available are related in that they share a common goal of increasing and developing muscular strength.

This weight training method of increasing and developing muscular strength is well known and frequently used. However, the weight training part of physical conditioning is performed at one time and the practice of the sport, exercise or activity is usually performed at another. Therefore, the two separate activities must be performed independently in two allocated time segments.

A more advantageous and beneficial method of weight training is to combine the weight training program with the actual training or practicing of the sport, exercise or activity. This can be accomplished by simultaneously practicing the desired sport, exercise or activity while wearing the Athletic Training Gloves of the invention.

The Athletic Training Gloves increase and develop muscular strength in the fingers, wrists, forearms and upper arms as the sport, exercise, or activity is being performed.

The prior art discloses a variety of exercise or sport-type gloves These range from sport gloves for providing grip to exercise gloves having discreet weights placed in the fingertips in order to resist the movement of the fingers and there by strengthen the finger muscles. U.S. Pat. No. 2,736,034 disclose such a fingertip-type weighted device. Each fingertip of the glove has a discreet weight to resist the motion of the fingers when the glove is being worn. This device is particularly suited for operations, such as typing and playing musical instruments. The U.S. Pat. No. 2,736,034 device is dependent on gravity for the direction of its resistance and only exercises the muscles which lift the fingers. The device is totally devoid of any assistance or exercise to the wrist, forearm, upper arm, or back of the hand, other devices, such as those disclosed in U.S. Pat. Nos. 4,138,100 or 4,197,592 or 3,707,730 are typically suited more for grip and hand formation than for exercise and muscle development in the wrists, forearms and upper arms.

U.S. Pat. No. 3,944,220 discloses a glove and hand exerciser having a plurality of discreet stiffening elements inserted into the glove and each finger canal to resist the movement of the fingers through a cantilever type stiffening action. However, this type of glove and hand exercise does not provide the type of multi-directional resistance necessary to strengthen the fingers, wrists, forearms and upper arms.

SUMMARY OF THE INVENTION

Accordingly, it is an object of the present invention to provide new and improved Athletic Training Gloves which overcome the various drawbacks and disadvantages of the prior art Athletic Gloves.

Another object of the present invention is to provide new and improved Athletic Training Gloves which can be used in numerous athletic activities as well as in other applications, such as medical rehabilitation, musical instrument practice and leisure activities.

Another object of the present invention is to provide new and improved Athletic Training Gloves which can be worn by many different types of athletes while simultaneously training for their respective sport, exercise or activity.

Another object of the present invention is to provide new and improved Athletic Training Gloves for athletes with desire to increase and develop muscular strength in the fingers, wrists, forearms and upperarms.

Another object of the present invention is to provide new and improved Athletic Training Gloves which create multi-directional muscle resistance in the fingers, wrists, forearms and upper arms, thus increasing and developing muscle strength for the athlete while he simultaneously trains for the sport, exercises or engages in an activity.

Another object of the present invention is to provide new and improved Athletic Training Gloves which maintain the hands in a productive and comfortable position during the training session.

Another object of the present invention is to provide new and improved Athletic Training Gloves which can be easily applied to and removed from the athletes hands.

Another object of the present invention is to provide new and improved Athletic Training Gloves which when removed, enable the athlete to perform at a higher, more productive level.

The Athletic Training Gloves of the type concerned herein develop muscular strength in the fingers, wrists, forearms and upperarms. The Athletic Training Gloves allow the athlete to train or practice for a sport, exercise or activity while wearing the Athletic Training Gloves. The simultaneous method of training for a particular sport, exercise or engaging in an activity with the Athletic Training Gloves on produces muscle resistance in the fingers, wrists, forearms and upperarms, thus increasing and developing muscular strength in these areas.

In numerous types of sports, greater strength is generally associated with greater performance. The Athletic Training Gloves increase and develop muscular strength in the fingers, wrists, forearms and upperarms. For example, increased strength in athletic activities such as baseball batting, tennis or hockey enables the athlete to hit the ball or puck with more force.

In each of these athletic activities, the Athletic Training Gloves are worn during training or practice sessions. In addition, these Athletic Training Gloves can also be directly beneficial to individuals who are in need of hand rehabilitation such as injured tendons in the hand. By opening and closing the hand many times while wearing the Athletic Training Gloves, strength can be restored.

The Athletic Training Gloves provide these capabilities because of the multi-directional muscle resistance they possess. The multi-directional muscle resistance effects the muscle movement of the fingers, wrists, forearms, and upper arms. The multi-directional muscle resistance separates and distinguishes itself, making the Athletic Training Gloves more complete and productive than that of prior devices. The multi-directional muscle resistance in the fingers, wrists, forearms and upperarms is caused by a layer of foam padding which lines the entire back of the hand. This form padding can be in the form of foam particles or a solid sheet of foam padding or any combination there of. This light weight foam padding extends from the back of the wrist to each of the five fingers, the foam padding also extends laterally beyond the width of each of the five fingers, thus creating a curl around each finger when the hand grasps an athletic apparatus or closes to a fist position. This foam padding does not interfere or hinder in any way with the palm side of the Athletic Training Gloves which could cause difficulties in gripping or maintaining a grip on any athletic apparatus.

The multi-directional muscle resistance established on the back of the hand produces lateral and longitudinal resistance. For example, when gripping a baseball bat the Athletic Training Gloves provide lateral and longitudinal muscle resistance to the back of the fingers as well as to the back of the palm. The lateral and longitudinal muscle resistance throughout the back of the hand produces the muscle resistances to the fingers, wrists, forearms and upper arms. As soon as the athlete grips the baseball bat with the Athletic Training Gloves on, the finger, wrist, forearm and upper arm muscles are being resisted by the foam padding layer on the back of the hand. Therefore, the athlete must use more strength to grip and maintain the grip on the baseball bat. The finger, wrist, forearm and upper arm muscles expand in size when the baseball bat is grasped and remain expanded during the entire training or practice session. The athlete now swings the baseball bat during the complete batting practice session. As this training session takes place, the athlete is simultaneously increasing and developing the muscles in the fingers, wrists, forearms and upper arms while practicing and perfecting his batting. At the end of the training or practice session the Athletic Training Gloves are removed for competition. As the athletes strength increases and develops in the fingers, wrists, forearms, and upper arms, the overall batting performance will continue to grow and prosper in the same fashion.

The Athletic Training Gloves of the invention can be worn during numerous other sports, exercises or activities such as, tennis, weight lifting, jumping rope, and racquet ball. Each of these athletic activities can be directly applied to the same example with baseball batting.

The Athletic Training Gloves can also benefit individuals who are in need of rehabilitation of hand movements. For example, an individual suffering from injured tendons in the hands, could use the Athletic Training Gloves to increase and develop muscular strength in the fingers, wrists, forearms and upper arms by opening and closing the hands many times with the Athletic Training Gloves on.

The Athletic Training Gloves could also be applied in the music Industry. For example, a drum player could use them to improve his strength and ability in playing the drums. By putting the Athletic Training Gloves on and practicing with them on, the finger, wrist, forearm and upper arm muscles will create resistance, thus increasing and developing muscular strength in these areas.

BRIEF DESCRIPTION OF THE DRAWINGS

The preferred embodiments of the invention will be described with references to the figures wherein.

DETAILED DESCRIPTION OF THE PREFERRED EMBODIMENT

Figure 3:
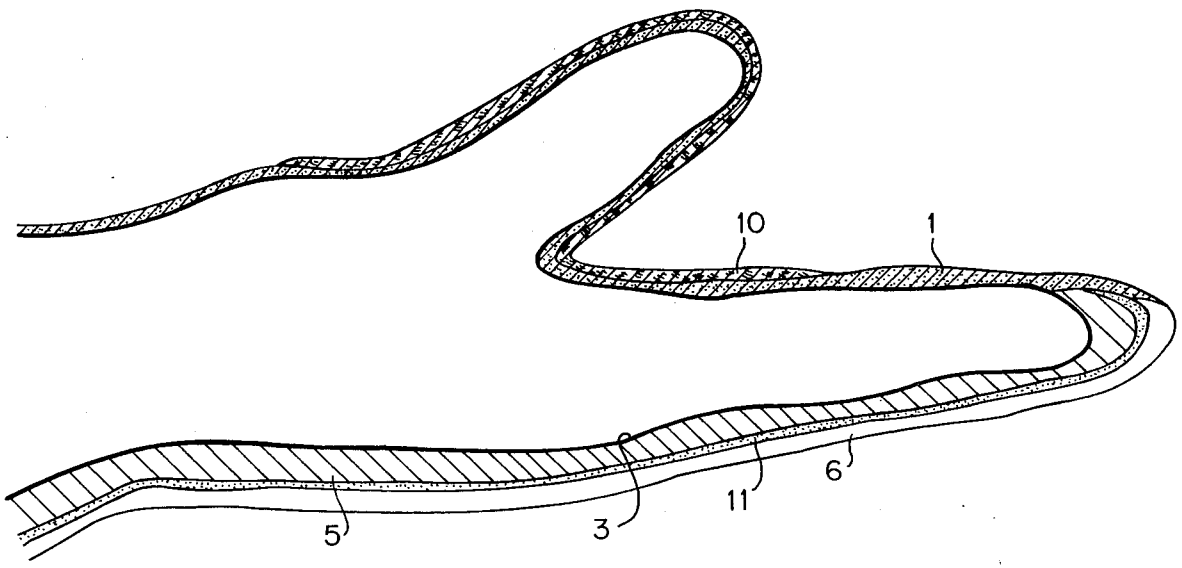
FIG. 3 is a longitudinal cross-section view of the Athletic Training Glove.

Referring to FIG. 3, the Athletic Training Gloves include a plurality of layers of different material to create an effective means of muscle resistance in the fingers, wrists, forearms and upper arms. With the palm side of the Athletic Training Glove facing up, there is one full complete layer of thin, durable leather 1 covering all the fingers, palm and ending at the wrist. Since there is much friction, wear and perspiration on the palm side of the Athletic Training Glove, a deerskin leather material is recommended because deerskin dries in a soft condition, enhancing the life of the Athletic Training Gloves. Deerskin is also a very durable, comfortable leather that is thin enough to grip and maintain a tight grip on any athletic apparatus. However, other materials may be used.

Figure 1:
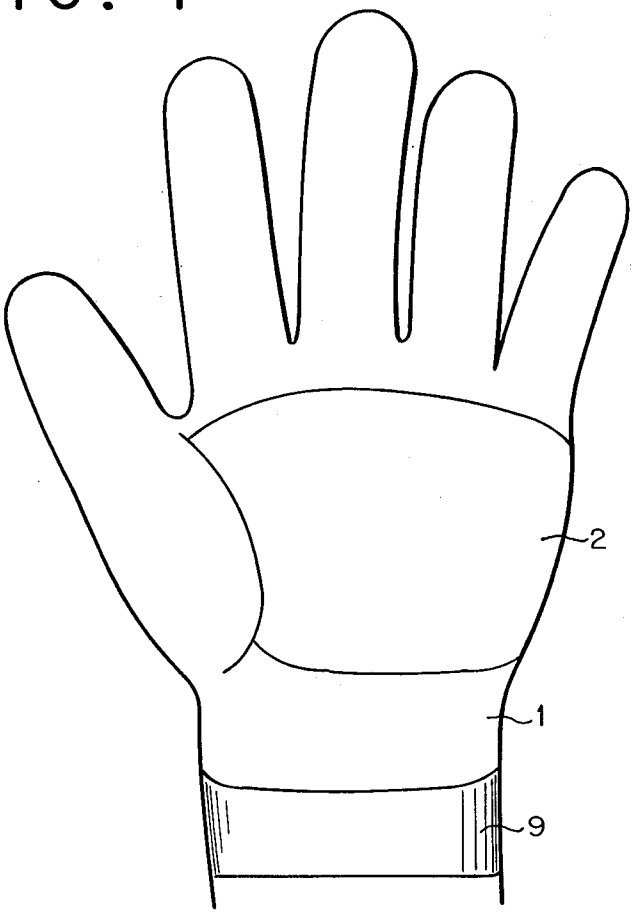
FIG. 1 is a plan view of the palm side of the Athletic Training Glove of the invention.

Since the palm of the hand receives the most wear and friction from athletic apparatuses, a thin padding 2 (FIG. 1) is applied to the palm area, leaving the four fingers and thumb with only one layer of thin durable leather. The thin padding exterior is also a thin, durable leather to give the Athletic Training Gloves extra durability, comfort and reliability. This second layer of padded thin, durable leather does not hinder in any way with the gripping of any athletic apparatus. It is understood that any other type of thin durable material may be used for these layers.

Continuing with the palm side up, beneath the first layer of thin, durable, leather is the hand. Turning the Athletic Training Glove over, palm side down, there is a layer 3 of the same thin durable leather on top of the hand. This layer of leather extends from the wrists and covers all the fingers. The top and bottom layers of leather form a "pocket" where the hand is in position.

Continuing with palms down, the layer immediately above the thin durable leather is the primary layer that creates the distinct multi-directional muscle resistance in the fingers, wrists, forearms and upper arms. This layer consists of a $\frac{3}{8}$" layer of polyurethane foam padding 5 that extends from the wrist and covers each of the five fingers. The foam padding also extends laterally beyond the width of each of the five fingers, thus creating a foam padding curl around each of the five fingers when the hand changes positions. This curl, however, does not interfere or hinder in any way with the palm side of the Athletic Training Gloves which could cause difficulties in gripping or maintaining a grip on any athletic apparatus. It is the foam padding location, on the entire back of the hand, that allows the multi-directional muscle resistance, both laterally and longitudinally, to take place. Although polyurethane foam is preferred, any type of foam, including sheets of foam padding, particles of foam padding or any combination thereof may be used. The Athletic Training Gloves must flex or compress in a lateral and longitudinal direction to create the fullest resistance for fingers, wrist, forearm and upper arm muscles.

Figure 2:
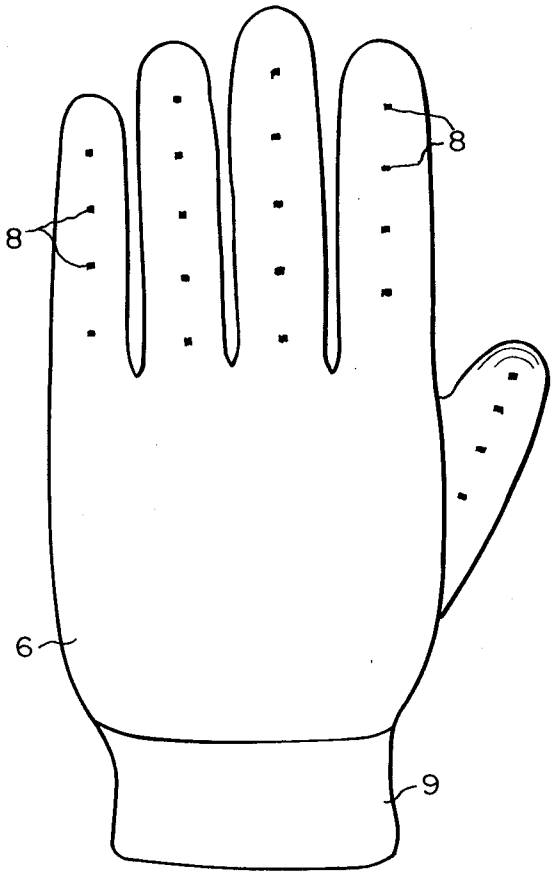
FIG. 2 is a rear view of the glove.

The outermost layer 6 (FIG. 2) directly on top of the polyurethane foam padding is a strong durable leather, like baseball mitt leather. Baseball mitt leather is very strong, durable and wears very well, this exterior layer, the baseball mitt leather, like the foam padding, covers the entire back of the hand and extends laterally beyond the width of each of the five fingers, creating a curl of the layer around each finger when the hand grasps an athletic apparatus or forms into a fist position. The baseball mitt leather does not interfere or hinder in any way with the palm side of the Athletic Training Gloves which could cause difficulties in gripping or maintaining a grip on any athletic apparatus.

A perforated air permeable layer 11 may be disposed between the foam layer and the outer layer. This permits air to communicate with the inside of the glove.

Each of the layers are attached to one another or, alternatively, each layer is attached to the layer above and below it, around its entire perimeter, except for the portion in the wrist section of the Athletic Training Glove where the hand enters. All of the layers combined form a "pocket" for receiving the hand when the glove is worn.

The outermost layers on the palm and back of the hand are joined to form a casing which defines finger spaces for receiving the fingers of the hand.

With the Athletic Training Glove palm side up, perforations 7 in the form of a straight line, are located on each of the four fingers and thumb to allow inner space ventilation and air circulation. These perforations are very beneficial to allow perspiration to escape and restored with fresh air. These perforations occur only on the four fingers and thumb, leaving the palm a solid leather panel.

Turning the Athletic Training Gloves palm side down, perforations 8 in the form of a straight line, are located on each of the four fingers and thumb to allow inner space ventilation and air circulation. Preferably there are four or five openings through the portion of the backing layer on each finger and thumb. In addition, the perforations are also located on the back of the palm area. Although perforations on the back of the palm are not essential, they can also vent and circulate air as well.

An elastic wristband 9 is used at the opening of the Athletic Training Gloves. If all layers of the Athletic Training Gloves are attached to one another, this elastic band may also be attached to all the layers of the training gloves or alternatively, a single layer on each side of the hand. This elastic band makes it easy for the athlete to put the Athletic Training Gloves on and take them off. This elastic band also keeps the hand in a comfortable, productive position. The elastic band grips the wrist and may extend to grip part of the forearm. Alternatively, a separable fastener such as VELCRO TM may be used on the wrist to maintain the most productive and consistent hand position. The separable fastener allows a wide range of settings for wearing comfort.

Figure 4:
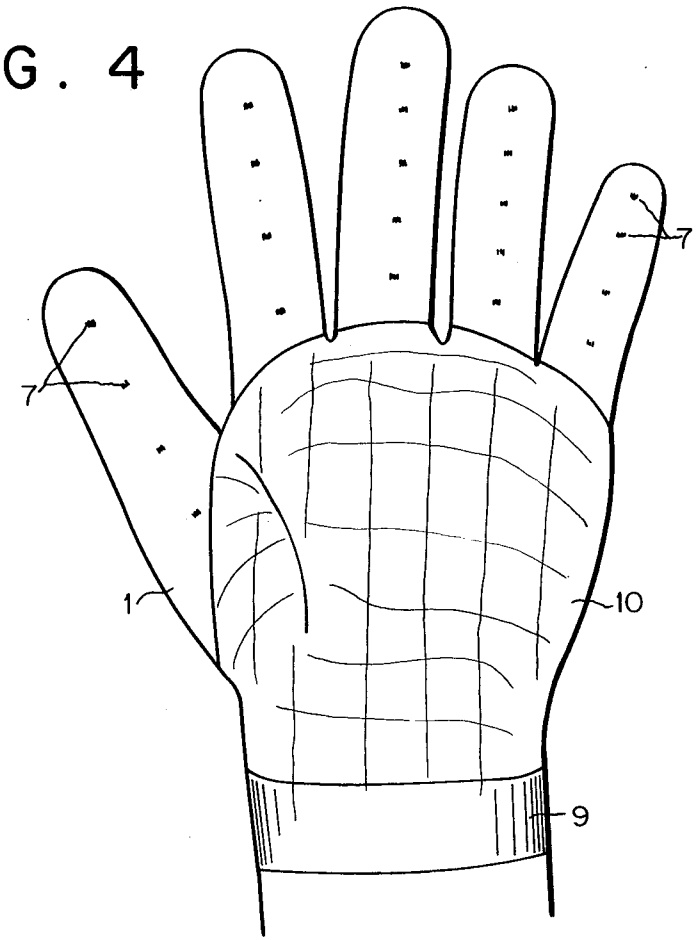
FIG. 4. is a plan view of the palm side of an alternate embodiment of the Athletic Training Glove of the invention.

Variations to the Athletic Training Glove structure may be made without exceeding the scope of the present invention. It is therefore understood that the second layer of padding on the palm of the Athletic Training Gloves could be substituted by a second layer of leather 10 (FIG. 4). In addition, the foam padding layer could naturally be less than or more than ⅜" thick. A similar type of leather could be substituted in place of the baseball mitt leather. A buckle could replace the elastic band. An additional layer may be added before or after the first thin durable layer of leather. Perforations are preferred but are not required. It is understood that the foam padding could be located on the palm side of the Athletic Training Gloves. It is understood that any light weight material could be substituted for the foam padding.

The main objective and purpose of the Athletic Training Gloves is to increase and develop muscular strength in the fingers, wrists, forearms and upper arms. This can be accomplished by training for a particular sport, activity, or exercise with the athletic Training Gloves on. This simultaneous effect will increase and develop the muscles in the fingers, wrist, forearm and upper arm for the desired sport, exercise or activity. The Athletic Training Glove structure is such that the foam padding does not interfere or hinder in any way with the palm side of the Athletic Training Gloves which could cause difficulties in gripping or maintaining a grip on any athletic apparatus.

After the workout session has been completed, the Athletic Training Gloves are removed. The finger, wrist, forearm and upper arm muscles have been worked hard, thus increasing the overall strength in the entire arm. This will make the individual stronger, more productive in the sports, exercises and activities that he pursues.

I claim:

1. A training glove comprising:

(a) a flexible outer glove casing defining individual finger spaces for receiving the fingers of a hand when the glove is worn;

(b) a resilient foam layer disposed within the casing contiguous to the part of the casing which is at the back of the hand when worn, said resilient foam layer covering substantially the entire back of the hand and back of the fingers and no portions of the palm or undersides of the fingers; and (c) a portion of said resilient foam layer extending laterally beyond the width of the fingers to produce a separation of the finger spaces when the fingers are extended.

2. The article according to claim 1 wherein:

(a) a liner is positioned on the side of said resilient foam opposite said casing.

3. The article according to claim 1 wherein:

(a) said casing defines openings which communicate with the internal space of the glove to permit air circulation between the outer environment and the inner space of the glove.

4. The article according to claim 1 wherein the casing comprises:

(a) a flexible protective portion forming a back panel, said back panel having a perimeter;

(b) a flexible portion thinner than said protective portion forming a front panel, said front panel having a perimeter contiguous to the perimeter of the back panel, said front panel being mounted to said back panel along their contiguous perimeters to form a glove.

5. A training glove made up of a plurality of layers and defining a space for receiving a hand, comprising:

(a) a liner of soft material surrounding and defining the hand receiving space for encompassing a hand when inserted therein;

(b) a resilient foam layer positioned on an outer surface of said liner on the portion of said liner which covers the back of the hand and fingers and no portion of the palm or undersides of the fingers;

(c) a perforated flexible backing layer in face-to-face contact with said foam layer on the side opposite said liner and attached to said foam layer about a glove defining perimeter; and (d) a flexible outer palm layer positioned on an outer surface of said liner on the portion of said liner which covers the palm and attached to said resilient foam layer and said protective layer about a glove defining perimeter.

6. The article according to claim 5 wherein the layer is a polyurethane foam.

7. The article according to claim 5 wherein the outer layer is made of a leather material.

8. The article according to claim 5 further comprising:

(a) a wear layer positioned on the outside of said palm layer and covering a portion of the palm which excludes the fingers.

9. The article according to claim 5 wherein the palm layer is made of a leather material.

10. A training glove made up of a plurality of layers and defining a space for receiving a hand, comprising:

(a) a liner of soft material surrounding and defining the hand receiving space for encompassing a hand when inserted therein;

(b) a resilient foam layer positioned on an outer surface of said liner on the portion of said liner which covers the back of the hand and fingers;

(c) a perforated flexible leather outer layer in face-to-face contact with said foam layer on the side opposite said liner and attached to said foam layer about a glove defining perimeter; and (d) a flexible leather palm layer thinner than said back layer positioned on an outer surface of said liner on the portion of said liner which covers the palm and attached to said resilient foam layer and said outer layer about a glove defining perimeter.

11. A training glove made up of a plurality of layers and defining a space for receiving a hand, comprising:

(a) a liner of soft material surrounding and defining the hand receiving space for encompassing a hand when inserted therein;

(b) a resilient foam layer positioned on an outer surface of said liner on the portion of said liner which covers the back of the hand and fingers;

(c) a perforated flexible outer layer in face-to-face contact with said foam layer on the side opposite said liner and attached to said foam layer about a glove defining perimeter;

(d) a flexible palm layer positioned on an outer surface of said liner on the portion of said liner which covers the palm and attached to said resilient foam layer and said outer layer about a glove defining perimeter; and (e) a perforated air permeable layer positioned between the resilient foam layer and the perforated outer layer.

12. A training glove comprising:

(a) a flexible outer glove casing defining finger spaces for receiving the fingers of a hand when the glove is worn, said casing including:

(i) a flexible outer layer forming a back panel; and (ii) a flexible portion thinner than said outer layer forming a front panel and mounted to said back panel along their contiguous perimeters;

(b) a resilient foam layer disposed within the casing contiguous to a part of the casing which is at the back of the hand when the glove is worn, said resilient foam layer covering substantially the entire back of the hand and back of the fingers in separate finger sections to permit independent movement of the fingers;

(c) a portion of said resilient foam layer extending laterally beyond the width of the fingers to produce a separation of the finger spaces; and (d) a further flexible wear layer disposed outermost on said thinner flexible portion and covering only the palm portion of the glove excluding the finger portions.

* * * * *